United States Patent [19]

Cain

[11] 4,295,794

[45] Oct. 20, 1981

[54] SELECTIVE MODE MULTI-STAGE VACUUM PUMP

[75] Inventor: Robert L. Cain, Bryan, Ohio

[73] Assignee: Robinair Manufacturing Corporation, Montpelier, Ohio

[21] Appl. No.: 5,604

[22] Filed: Jan. 22, 1979

[51] Int. Cl.[3] ..... F04B 23/04

[52] U.S. Cl. ..... 417/62; 417/244; 417/360; 418/39; 418/97; 418/147

[58] Field of Search ..... 417/404, 403, 62, 238, 417/410, 244, 360; 418/39, 97, 98, 99, 100, 149

[56] References Cited

U.S. PATENT DOCUMENTS

| | | | |
|---|---|---|---|
| 1,913,657 | 6/1933 | Buchanan et al. | 418/97 |
| 3,136,478 | 6/1964 | Soumerai | 417/62 |
| 3,578,879 | 5/1971 | Long | 417/62 |
| 3,791,780 | 2/1974 | Fritch et al. | 418/99 |
| 3,837,764 | 9/1974 | Fritch et al. | 417/62 |
| 3,982,864 | 9/1976 | Cain | 418/149 |
| 4,120,621 | 10/1978 | Pikul | 418/99 |

*Primary Examiner*—Billy S. Taylor
*Attorney, Agent, or Firm*—Beaman & Beaman

[57] ABSTRACT

The invention pertains to vacuum pump structure, and the innovations include a multiple pumping chamber pump wherein substantially identical pumping chambers may be assembled in contiguous relationship, and by the selective use of a pump head plate mounted upon both chambers the pump may operate in either a series or parallel mode. Further innovations include a novel air conducting nozzle which minimizes oil loss, and the pump employs a combination carrying handle and base interposed between the motor and pumping structure which facilitates assembly and handling.

2 Claims, 10 Drawing Figures

SELECTIVE MODE MULTI-STAGE VACUUM PUMP

SUMMARY OF THE INVENTION

The invention pertains to electrically driven vacuum pumps of the portable type, and particularly to multiple chamber pumps selectively assembled in series or parallel modes.

Portable electrically driven vacuum pumps are widely used in the servicing of refrigeration systems, such as employed in refrigerators, food display cabinets, and in vehicle, domestic and industrial air conditioning systems. Such pumps must be relatively lightweight for ease of handling, capable of producing efficient vacuums, simple in operation and use, while capable of withstanding abuse and a wide range of operating temperature conditions.

The assignee has developed multi-stage vacuum pumps which are used for refrigeration servicing as shown in U.S. Pat. No. 3,982,864, and has also produced multiple stage vacuum pumps of a portable nature as shown in U.S. Pat. Nos. 3,791,780 and 3,837,764. These latter patents disclose multiple stage pumps having valve apparatus which selectively permits the pumps to operate in parallel to produce a high-pumping capacity during initial stages of evacuation, and upon valve actuation, the pump chambers are interconnected in series to reduce the pumping capacity but increase the degree of vacuum attainable. While the assignee's previous pump constructions have enjoyed commercial acceptance there is the need for less expensive multiple pumping chamber vacuum pumps, and the oil retention abilities of such vacuum pumps can be improved.

It is an object of the invention to provide a portable, electrically driven, multiple-stage vacuum pump utilizing cast pumping chambers capable of being contiguously assembled wherein a common chamber head plate selectively assembles the pumping chambers in either a series or parallel mode, depending upon the pumping capacity and vacuum desired.

It is a further object of the invention to provide an electrically driven vacuum pump construction utilizing a plurality of pumping chambers wherein the pumping chambers are of substantially identical construction whether used either in a parallel or series mode, thereby reducing manufacturing costs, and where the major difference between parallel and series pumps lies in the configuration of the chambers head plate and the location of the passages defined therein.

A further object of the invention is to provide a vacuum pump oil deflector which is of an inexpensive construction and is capable of minimizing oil loss during pump operation.

Another object of the invention is to provide a portable electric motor operated vacuum pump assembly wherein a synthetic plastic combination support handle and pump base is interposed between the motor and pumping chambers and serves as the common support for the motor and pumping chambers.

In the practice of the invention an electric motor is mounted upon one side of a synthetic plastic combination handle and base, while a pair of vacuum pump chambers are mounted upon the other side of the handle-base. The motor shaft extends into the cast pumping chambers and eccentric displacer members mounted upon the shaft, in conjunction with valve structure, produces a vacuum within the pumping chambers. The pumping chambers communicate with inlet and outlet passages, and each chamber is defined within its own cast housing. The chamber housings are interconnected by bolts, and the entire assembly employs bolts and threaded fasteners in assembly.

Oil reservoirs are defined in each casting above the pumping chamber, and the associated chamber discharges into the oil reservoir. The oil reservoirs are enclosed at their upper region by a common head plate, and depending upon whether the pumping stages are connected in a parallel or series mode passages defined in the head plate either connect both stage inlets to the conduit being evacuated, or the head passage interconnects the outlet at one stage to the inlet of another to form a series pumping mode.

Each pumping chamber discharges into its associated reservoir through check valve structure, and an oil deflector is mounted within each oil reservoir communicating with the check valve and includes a nozzle outlet conduit of arcuate configuration having a discharge end extending away from the head plate. This nozzle directs air discharged from the pumping chamber in a direction away from the head, and minimizes the loss of oil through the head exhaust port.

The combination carrying handle and pump support base is preferably formed of a synthetic plastic material and includes fastener receiving openings permitting the motor to be mounted upon one side of the base, while fastener receiving openings also cooperate with the adjacent pump casting for mounting the same upon the base. An opening in the handle permits the motor drive shaft to pass therethrough into the pump castings. The use of the combination carrying handle and support permits balanced carrying of the assembled unit, and provides a cushioned base for the pump while operating.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
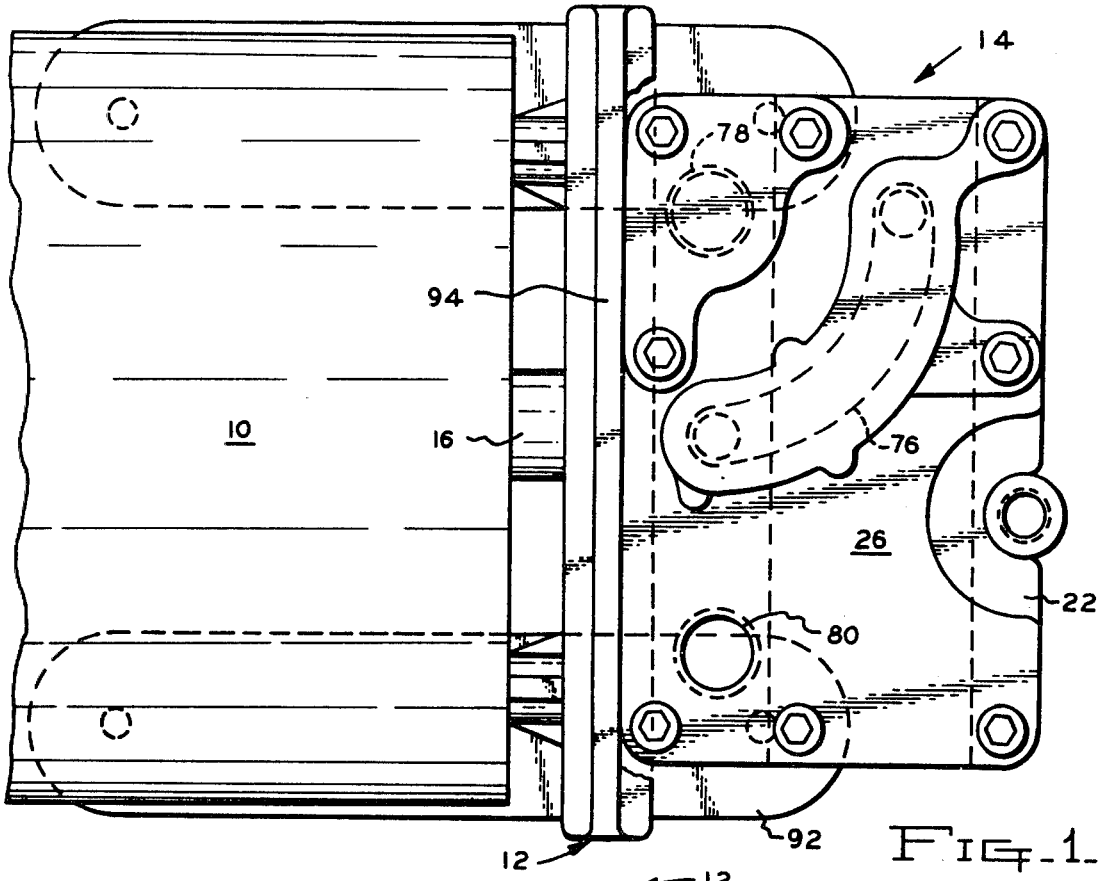
FIG. 1 is a partial top plan view of a vacuum pump constructed in accord with the invention utilizing the series mode head.
Figure 2:
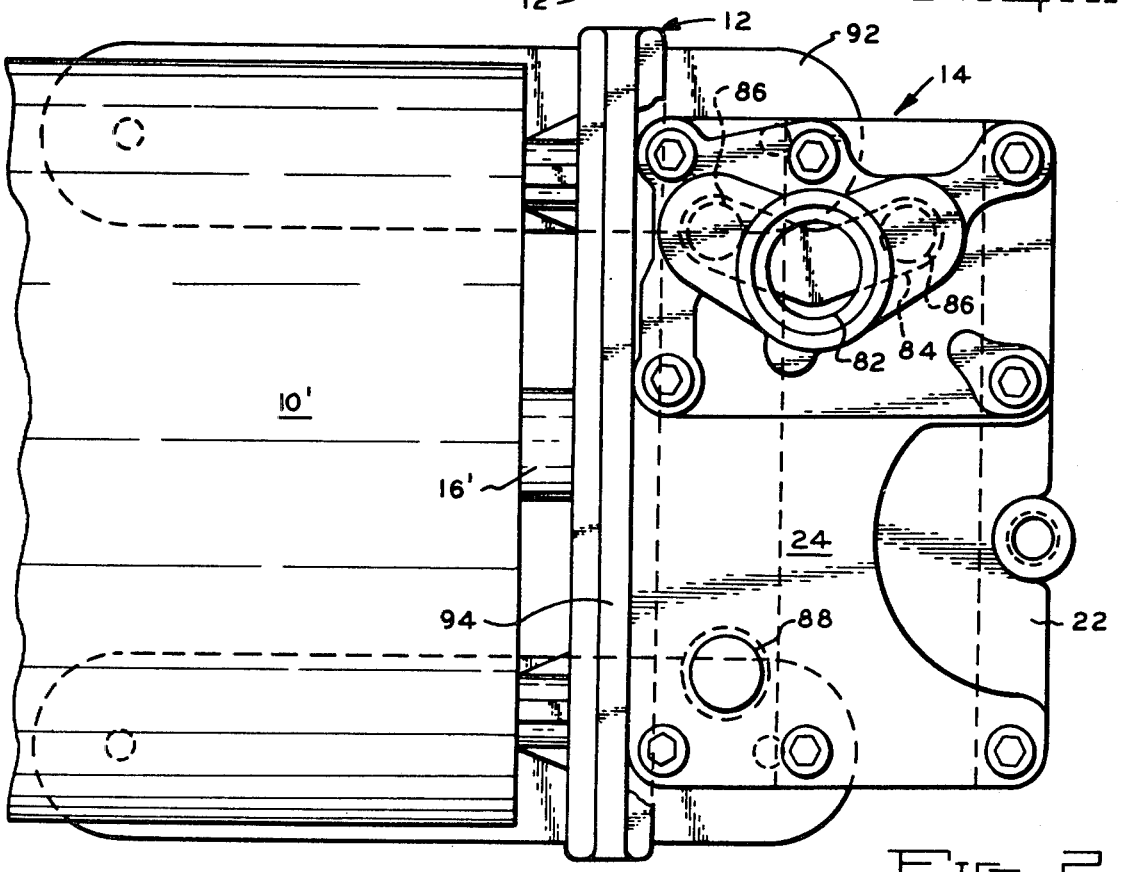
FIG. 2 is a plan view similar to FIG. 1 illustrating a pump employing the parallel mode head.

In the basic relationship of the components of the invention an electric motor 10 is mounted at its end to the base and handle member generally indicated at 12, and the pump generally indicated at 14 is mounted to the opposite side of the base member 12, as will be apparent from FIGS. 1 and 2. The concept of mounting a vacuum pump adjacent the end of an electric motor is illustrated in the assignee's U.S. patents previously mentioned. The base member 12 includes an opening through which the motor drive shaft 16 extends, and as will be later described, threaded fasteners connect the motor and adjacent pump casting to opposite sides of the base.

Figure 3:
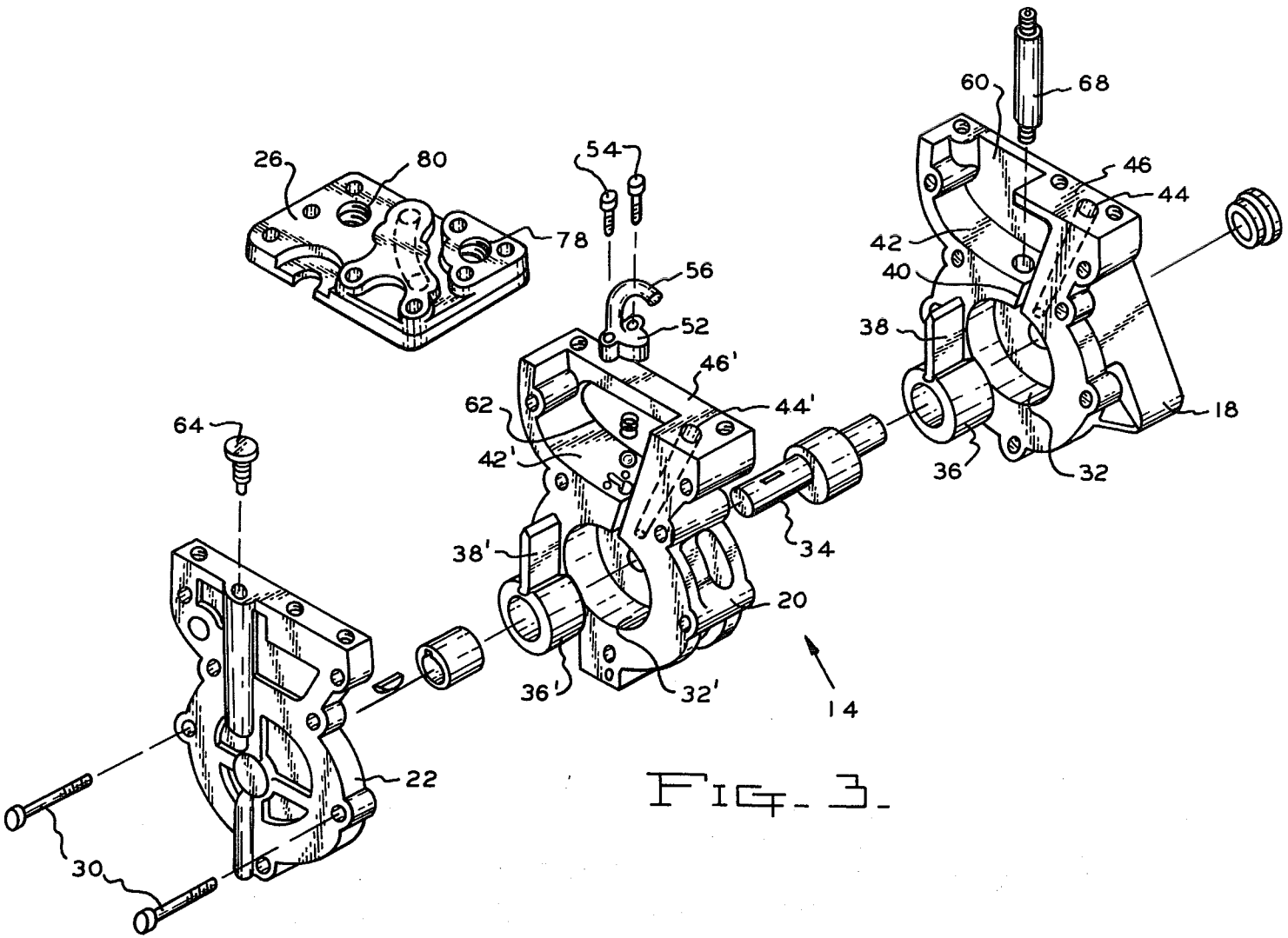
FIG. 3 is an exploded perspective view illustrating the components of a vacuum pump in accord with the invention for use in a series mode.
Figure 4:
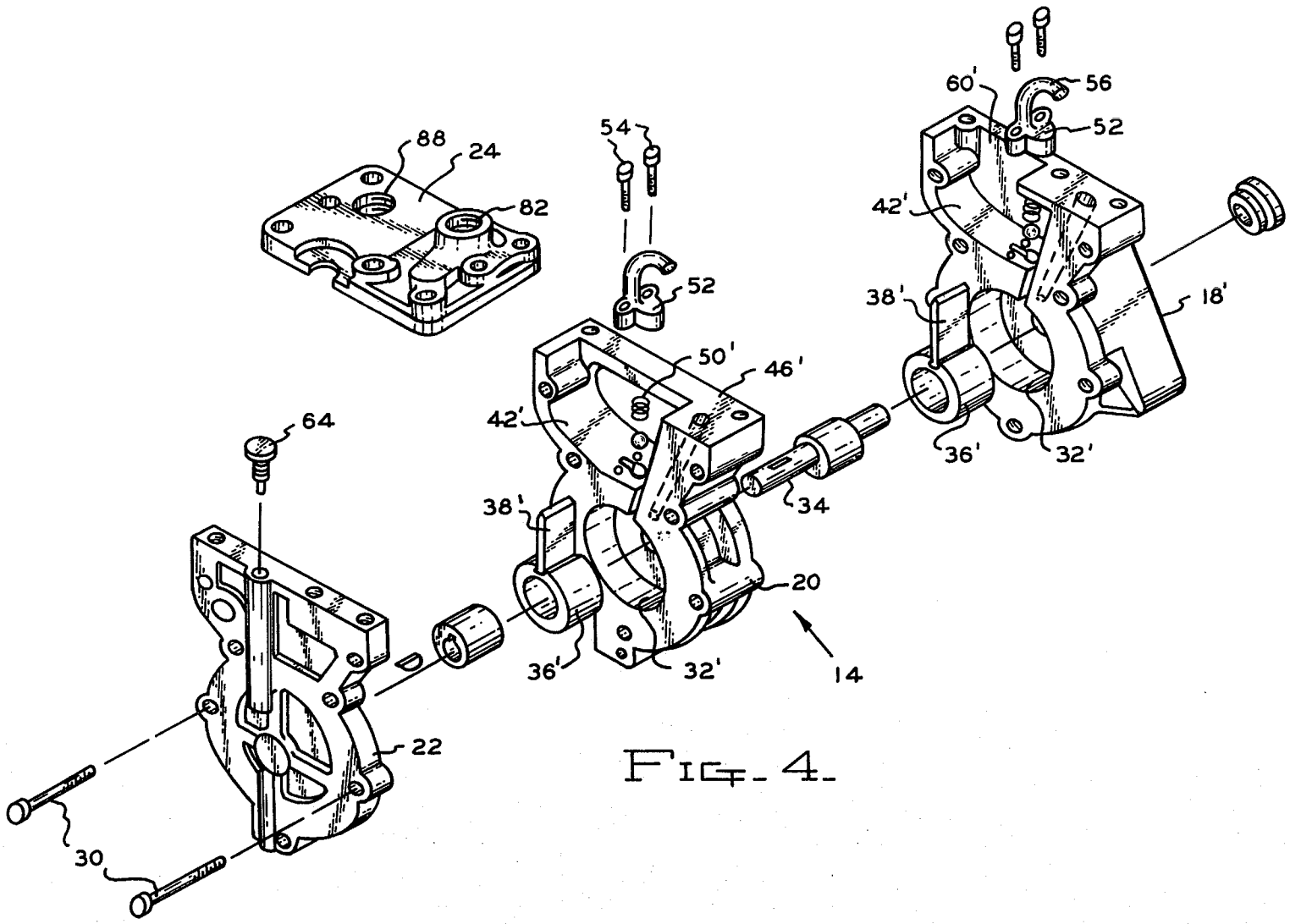
FIG. 4 is an exploded perspective view of the components of a vacuum pump in accord with the invention as used in a parallel mode.
Figure 10:
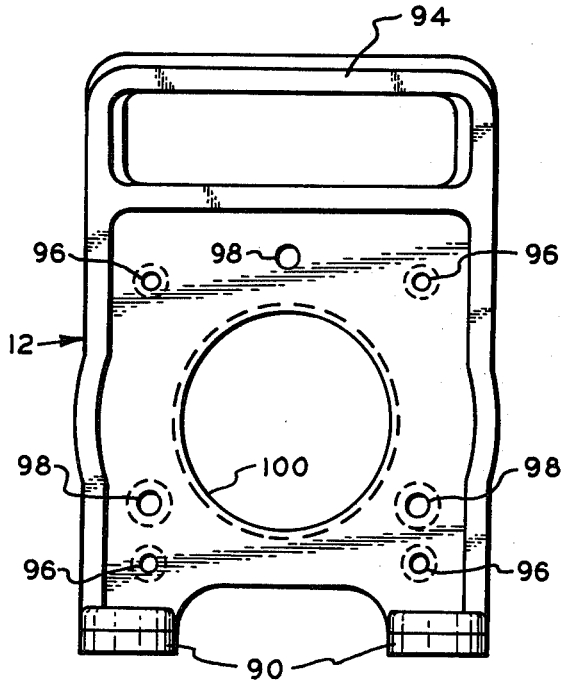
FIG. 10 is an end elevational view of the support handle and base assembly, per se.

As will be apparent from FIGS. 3 and 4, the pump consists of a pair of cast casings 18 and 20, a cast end plate 22, and a cast head plate 24 or 26 which is bolted in place. The casing 18 is mounted directly to the base 12 by fasteners, not shown, extending through holes defined in the base, FIG. 10.

The second pump casing 20 is assembled to casing 18 by bolts 30, and these bolts also attach the end plate 22 to the casting 20, the bolts extending through aligned holes and threaded into threaded bores defined in the casing 18.

The casings 18 and 20 are identical in most respects, and in the following description identical components described with respect to casing 18 are indicated by primed numerals in casing 20.

The casing 18 includes a cylindrical pumping chamber 32 which is concentric to the motor drive shaft 16 and the axis of crankshaft 34 which extends through the chambers 32 and 32' and is driven by shaft 16. A displacer rotor 36 is eccentrically rotatably mounted upon the shaft 34 within the chamber 32 for rotation with the crankshaft and as the periphery of the rotor 36 engages the periphery of the chamber 32 rotation of the rotor will create expanding and contracting voids within the chamber producing the pumping action in the known manner. The chamber 32 is divided by the vane 38 pivotally mounted within the rotor periphery and slidably received within a slot 40 defined intermediate the chamber 32 and the oil reservoir 42. The inlet passage 44 to the chamber 32 is defined in the casing 18 intersecting the casing head surface 46 at its upper end, and intersecting the periphery of the chamber 32 adjacent the vane 38, FIG. 7. The outlet of the chamber 32 is through spring-biased check valve 48, and the check valve 48 communicates with the reservoir 42 defined in the upper region of the casing.

In the parallel embodiment in casing 18, and in casing 20, the check valve spring 50 is located within a deflector nozzle housing 52 mounted within the oil reservoir over the check valve by a pair of bolts 54. The deflection nozzle housing communicates with the key-shaped chamber in which the check valve 48 is located, and includes an arcuate nozzle conduit 56 having a discharge end 58 substantially horizontally directed. Thus, air pumped from the chamber 32 passes through valve 48 and into the reservoir through arcuate conduit 56. The orientation of the discharge end 58 directs the air passing therethrough in a horizontal and slightly downward direction and prevents the upward discharge of oil bearing air forced from chamber 32.

The pump casing 18 includes a closed wall 60 disposed adjacent the base 12, but the pump casing 20 includes opening 62 whereby the reservoirs 42 and 42' of the casings are in comunication, and as will be later described, only a single exhaust or outlet port is required in the pump head plate in view of this communication between the reservoirs.

The end plate 22 seals against the end surface casing 20, and the end plate may include a ballast air chamber controlled by valve 64. A description of the purpose and operation of the ballast air passage will be appreciated from U.S. Pat. No. 3,837,764.

Figure 7:
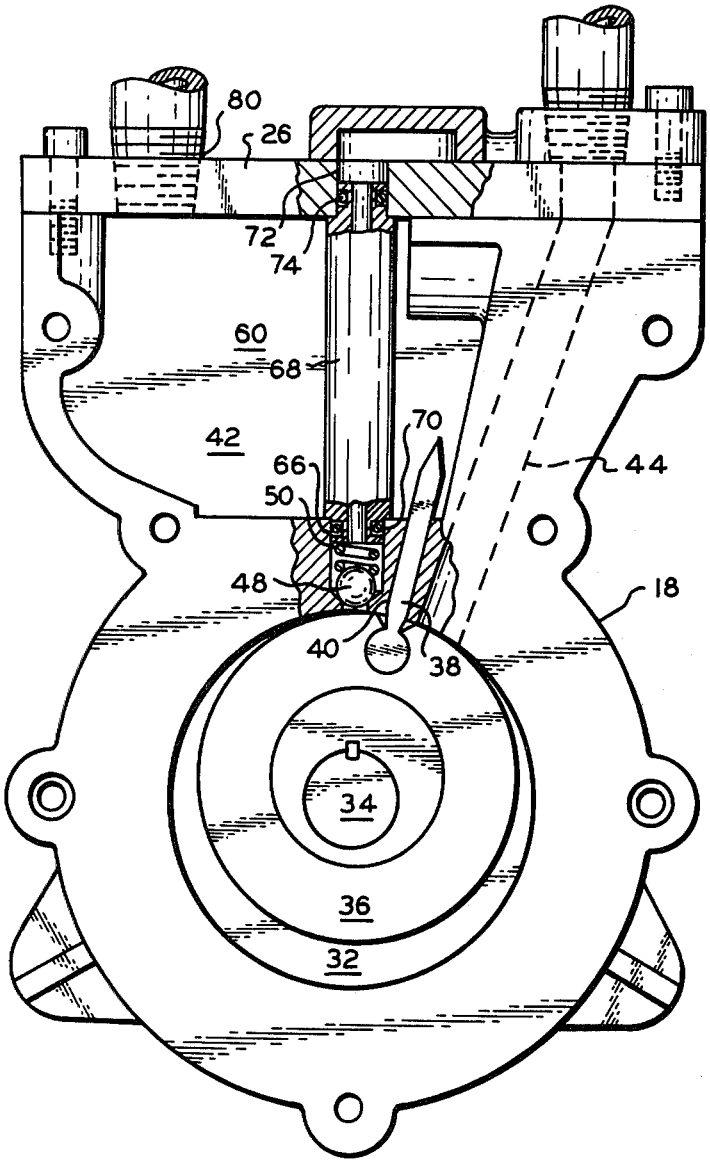
FIG. 7 is an elevational, sectional view of the first stage pump casting of the series mode assembly.
Figure 8:
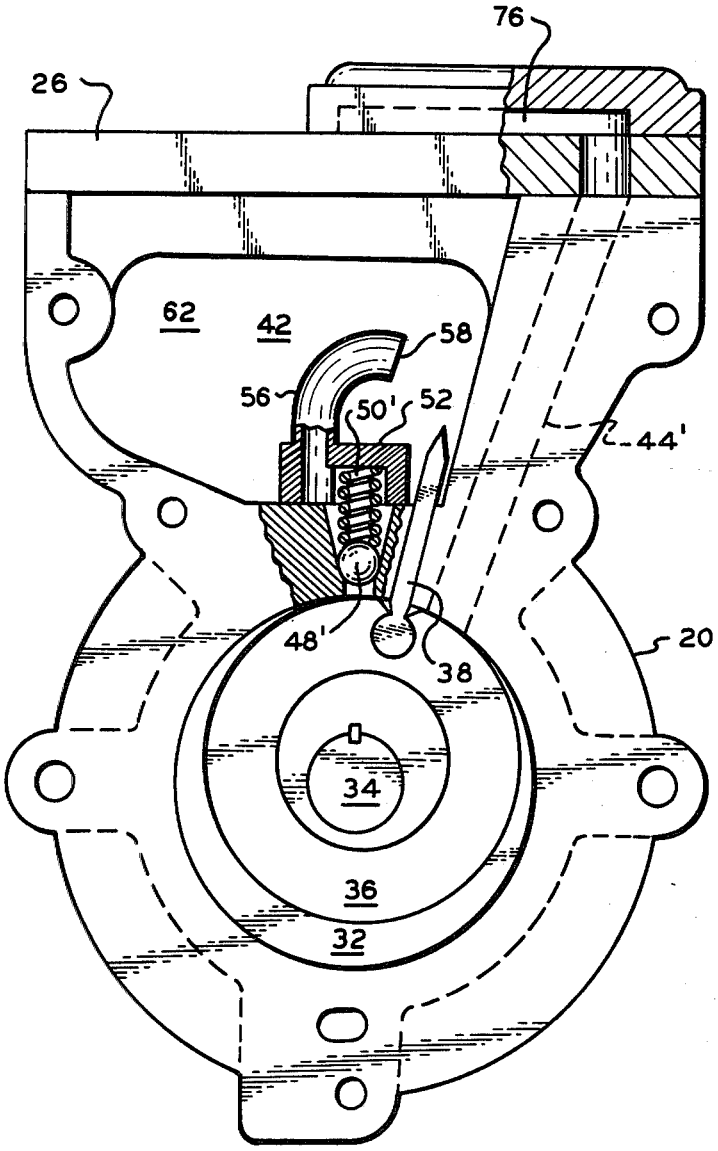
FIG. 8 is an elevational, sectional view of the second stage casting, portions of the deflecting nozzle being broken away.

If the pump defined by casings 18 and 20 is to be assembled in a series mode, the check valve outlet passage 66 of casing 18 is machined to receive the lower end of a cross-over conduit 68 sealed thereto by an O-ring 70, FIG. 7. The head plate 26 attached to the upper ends of the casings 18 and 20, in the series mode, includes a vertical passage 72 receiving the upper end of the conduit 68 and is sealed thereto by O-ring 74, FIG. 7. The configuration of the head 26 will be appreciated from FIGS. 1, 3, 6 and 7, and includes an arcuate passage 76 communicating with the conduit 68 at one end, and the passage 76 communicates with the second stage inlet passage 44', FIG. 3. In this manner air pumped from chamber 32 passes through conduit 68 into chamber 32', and chamber 32' is evacuated into the reservoirs 42' and 42.

Head 26 includes a threaded inlet port 78 to which the plumbing is connected for evacuating the refrigeration system being serviced by the pump, and threaded outlet port 80 defined in head 26 communicates with the reservoirs of casings 18 and 20 and an exhaust muffler, conduit of the like, not shown, is attached to the threaded port 80 for disposing of the air being evacuated by the pump.

Figure 5:
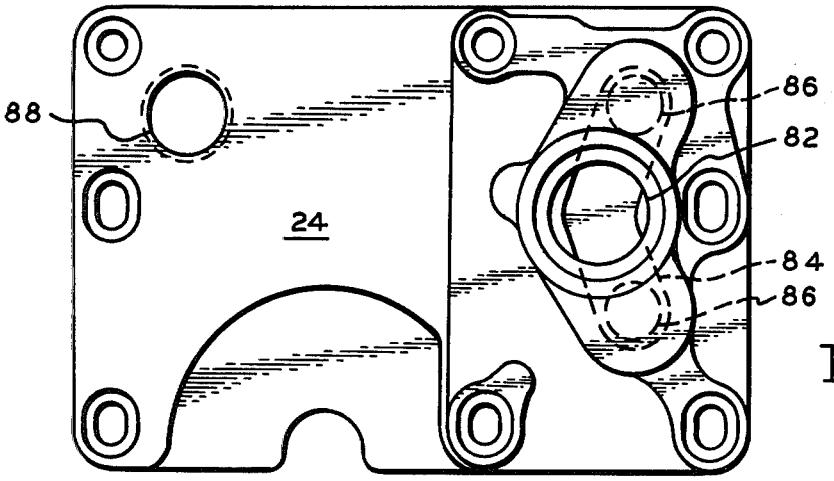
FIG. 5 is a plan view of a parallel mode head, per se.
Figure 6:
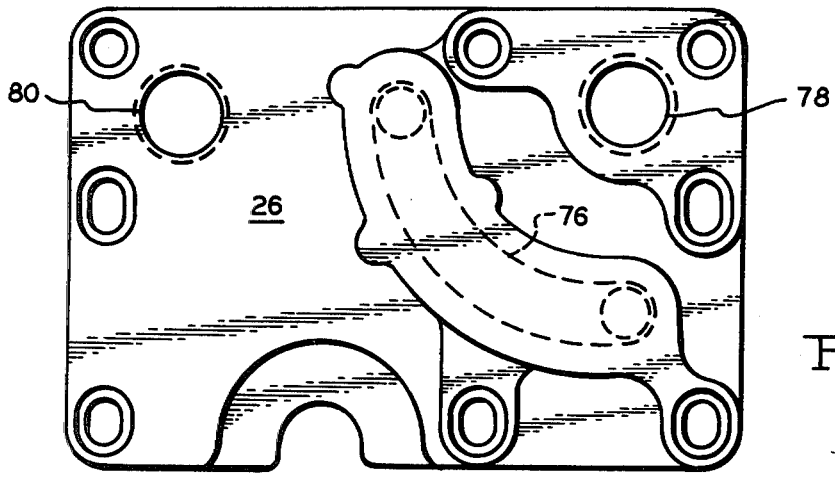
FIG. 6 is a plan view of a series mode head, per se.
Figure 9:
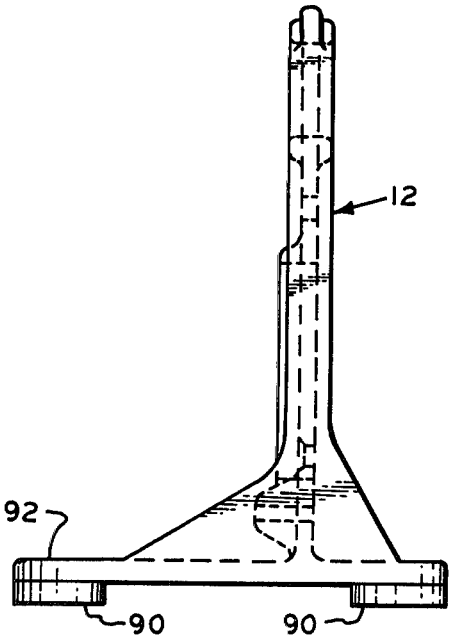
FIG. 9 is a side elevational view of the support handle and base assembly.

If the disclosed pump structure is to be used in a parallel pumping mode the head 24 takes the form shown in FIGS. 2, 4 and 5. The head 24 includes an inlet port 82 which is threaded to receive the plumbing, not shown, associated with the system being evacuated, and the port 82 communicates with a passage 84 having a pair of outlets 86, associating with pump casing passages 44 and 44'. Thus, the air being evacuated is equally divided between the pump stages, substantially equal amounts of air being drawn into the chambers 32 and 32'.

Of course, when the pump stages are utilized in the parallel mode an oil deflector 52 is used with each check valve 48 and 48', FIG. 4, and the air evacuated by the pump passes through the threaded exhaust port 88 defined in the head 24 through a suitable muffler, conduit, etc., not shown.

The base 12 is preferably molded of a synthetic plastic material and includes at the lower region, resilient legs or pads 90 bolted to the base leg platform 92 for supporting the pump in a resilient manner to absorb vibration. The upper portion of the base forms a handle 94 by which the entire pump assembly may be readily carried. As the base 12 is located intermediate the motor 10 and pump 14 a substantially equal distribution of weight exists on the sides of the base 12 facilitating balance. The holes 96 formed in base 12 receive bolts which attach the end of the motor 10 to the base, and the holes 98 receive bolts for connecting the casing 18 to the base, and the opening 100 provides adequate clearance for the motor drive shaft 16.

As the reservoirs 42 and 42' are partially filled with lubricating oil in order to oil the vanes 38 and 38' and the chambers 32 and 32' the air as it is exhausted from the associated chamber includes a fine mist of oil particles, and such oil particles in conventional vacuum pump constructions are usually forced from the reservoir outlet and such loss of oil requires frequent oil replacement. However, with the use of the deflector nozzle 56 the loss of such oil is minimized, and as the discharge end 58 of the nozzles 56 is disposed away from the head plate and the exhaust ports thereof, a substantial savings in oil is achieved.

The aforedescribed casing construction permits either parallel or series mode vacuum pumps to be manufactured of similar castings, and the only variation in machining is that required to accommodate either the conduit 68, or the oil deflector 52 of casing 18. Thus, the disclosed construction minimizes manufacturing costs while providing the purchaser with a dependable and long-lasting pump.

It is appreciated that various modifications to the inventive concepts may be apparent to those skilled in the art without departing from the spirit and scope of the invention.

I claim:

1. In a rotary vacuum pump having a pair of pump casings each having a pumping chamber defined therein housing a rotary displacer, an electric motor in driving connection with said displacers, an inlet defined in each of said casings in communication with the associated chamber, an oil reservoir defined in each of said casings above the associated chamber, an outlet passage interconnecting the chamber and reservoir of a common casing, a single head superimposed upon said casings enclosing the reservoirs thereof, the improvement comprising a cross-over conduit mounted upon one of said pump casings within the oil reservoir thereof having a first end communicating with the outlet passage of said one casing and a second end communicating with a cross-over passage defined in said head, said conduit including sealing means adjacent said ends, said cross-over passage communicating with the inlet of the other pump casing whereby said cross-over conduit and passage establish a series interconnection between the pumping chambers of said casings, and an outlet port defined in said head in communication with said oil reservoir of said other casing.

2. In a rotary vacuum pump as in claim 1 wherein said cross-over conduit comprises a cylindrical conduit and said sealing means on each end for cooperating with the associated casing outlet passage and head cross-over passage comprising ring means.

* * * * *